United States Patent [19]

Everhardus et al.

[11] Patent Number: 4,739,591

[45] Date of Patent: Apr. 26, 1988

[54] METHOD FOR PRODUCING A SCREENED LAYER FOR AN ELECTROPHOTOGRAPHIC ELEMENT

[75] Inventors: Roelof H. Everhardus, Lomm; Hubertus G. Eggels, Swalmen; Ronald Berkhout, Venlo, all of Netherlands

[73] Assignee: Oce-Nederland B.V., Venlo, Netherlands

[21] Appl. No.: 885,384

[22] Filed: Jul. 14, 1986

Related U.S. Application Data

[63] Continuation of Ser. No. 783,939, Oct. 3, 1985, abandoned.

[30] Foreign Application Priority Data

Oct. 15, 1984 [NL] Netherlands ..... 8403134

[51] Int. Cl.[4] ..... B24C 1/00

[52] U.S. Cl. ..... 51/319; 430/127

[58] Field of Search ..... 51/319, 320, 310–312, 51/413, 326; 427/264; 430/127, 132, 133, 66; 156/645

[56] References Cited

U.S. PATENT DOCUMENTS

| | | | |
|---|---|---|---|
| 2,666,008 | 1/1954 | Enslein | 51/312 |
| 3,435,560 | 4/1969 | Andersen | 51/413 |
| 3,579,368 | 5/1971 | Bleiweiss | 51/319 |
| 3,702,042 | 11/1972 | Cochran et al. | 51/413 |
| 3,992,819 | 11/1976 | Schmall | 51/413 |
| 4,027,323 | 5/1977 | Lorenze et al. | 51/310 |
| 4,232,059 | 11/1980 | Proffitt | 51/310 |

FOREIGN PATENT DOCUMENTS

| | | | |
|---|---|---|---|
| 0030337 | 3/1978 | Japan | 430/127 |

*Primary Examiner*—Frederick R. Schmidt
*Assistant Examiner*—Bradley I. Vaught
*Attorney, Agent, or Firm*—Reed Smith Shaw & McClay

[57] ABSTRACT

A method of producing a screened layer on an electrophotographic element by applying a homogeneous layer to a support and removing small areas from the layer by blasting it with particles having a diameter of between 5 and 1000 μm.

4 Claims, No Drawings

METHOD FOR PRODUCING A SCREENED LAYER FOR AN ELECTROPHOTOGRAPHIC ELEMENT

This is a continuation of co-pending application Ser. No. 783,939 filed on Oct. 3, 1985, now abandoned.

BACKGROUND OF THE INVENTION

1. Field of the Invention

The present invention relates to a method for producing a screened layer for an electrophotographic element by applying a homogeneous layer to a support suitable for electrophotographic use and removing small areas from the layer.

2. Description of the Prior Art

Examples of screened photoconductive elements are disclosed in *IBM Technical Disclosure Bulletin,* Vol. 18, No. 10, March 1976 at pp. 3164–65 and *Xerox Disclosure Journal,* Vol. 5, No. 2, March–April 1980 at p. 131. The Xerox disclosure mentions forming an insulating dot pattern by overcoating with a blocking layer. The IBM disclosure mentions the evaporation of the charge generation material through a pattern mask. Neither mentions forming the screened pattern by the removal of material.

U.S. Pat. No. 2,777,256 relates to a method of cleaning and roughening a metallic support surface in preparation for the application of a coating layer by blasting with a spray of fine abrasive particles. The entire metallic support surface is blasted according to U.S. Pat. No. 2,777,256 with a large portion of the surface being removed. French Pat. No. 2,522,992 discloses a blasting method for roughening a metallic surface similar to the method described in U.S. Pat. No. 2,777,256.

European Patent Application 0,025,253 relates to an optical recording disk in which holes are made in a recording layer by means of a laser. The substrate under the recording material has been roughened or scratched chemically or mechanically so that the recording layer exhibits the same discontinuities. It is a very time consuming process to generate a large number of holes in the recording material in this manner.

Netherlands Patent Application 8,400,922, which is not a prior publication, discloses a method for producing a screened layer for an electrophotographic element by applying a homogeneous layer to a support. Small areas are then removed from a charge-generating layer applied to the support in accordance with a dot or line pattern by means of a laser. An excellent screened layer can be produced by using this method. The disadvantage of this method, however, is that it is fairly time consuming if part of the layer, for example 25%, is to be removed on a large scale in the form of small areas of a size, for example, of about 25 μm. Thus, there is a need for a method of quickly removing on a large scale, small areas of a layer for an electrophotographic element to produce a screened layer.

SUMMARY OF THE INVENTION

Generally, the present invention provides a method for producing a screened layer for an electrophotographic element by applying a homogeneous layer to a support suitable for electrophotographic use and removing small areas from the layer. It has now been found that the small areas can be removed from the homogeneous layer much more quickly by blasting the layer with particles having a diameter of between 5 and 1000 μm. Depending upon the specific blasting conditions, the blasting particles can remove small areas having a diameter of between about 1 and 200 μm from the homogeneous layer producing a screened pattern in the layer.

DESCRIPTION OF THE PREFERRED EMBODIMENTS

In using the method of the present invention, the shape of the blasting particles is not critical. Preferably, particles without sharp edges, such as glass pearls, are used to prevent excessively large pieces from being knocked out of the homogeneous layer. Similarly, the material of the blasting particles is also not very critical. The particles, of course, should consist of a material having a greater abrasion strength than that of the layer to be treated.

It must also be taken into account that small pieces of the blasting particles may break off and remain in the treated layer. For example, if the treated layer is used in an electrophotographic element whose electrophotographic properties might be unfavorably influenced by traces of a conductive material, it would be desirable to use electrically insulating particles as the blasting particles. Similarly, if traces of an electrically insulating material in the electrophotographic element have an unfavorable effect on its properties, electrically conductive particles are preferred as the blasting particles.

It has been found that the method of the present invention can be used in connection with all kinds of layers occurring in electrophotograhic elements. Such layers would include thin metal layers, polymer layers which may or may not contain solids in dispersed form, and layers of vapor-coated monomeric substances such as selenium, phthalocyanine, perylene dyes, and other photoconductive substances.

The optimum blasting conditions vary from case to case depending upon the material to be removed, its thickness, and the size and pattern of the areas to be removed. In a preferred embodiment, glass pearls of a diameter of between 20 and 200 μm, at a blasting pressure from 0.2 to 5 bars and with a distance of 10 to 50 cm between the blasting aperture and the layer to be blasted, will generally be adequate to produce the desired results. The angle between the blasting direction and the surface undergoing blasting is not critical. Angles between about 10° and 90° can be used.

The values given above for the different blasting conditions are not intended as limits. Generally, it is possible to exceed any of the indicated margins without difficulty and yet obtain a good result by adjusting one of the other conditions. For example, the pressure can be increased if a corresponding increase in the distance from the surface undergoing blasting is made or, conversely, the pressure and the distance both can be reduced. The effect of increasing the particle size can also be compensated for by varying the pressure. Other variations to these conditions can be made.

The present invention will be explained in detail by reference to the following example:

EXAMPLE

A homogeneous phthalocyanine layer of a thickness of 0.3 μm was vapor coated on an aluminum-covered synthetic plastic support. This layer was blasted for 5 seconds with glass pearls of diameters varying between 44 and 88 μm. The pearls were applied to the phthalocyanine layer by compressed air at an angle of 45° using a commercial blasting machine which recirculates the pearls. The excess pressure in the exit aperture of the blasting machine's blasting nozzle was 1.5 bars. The distance between the exit aperture and the phthalocyanine layer was 30 cm. After blasting, 20% of the surface of the phthalocyanine layer was found to have been removed in the form of arbitrarily distributed holes, 95% of which had a diameter ranging between 5 and 30 μm.

It was possible to provide the resulting screened phthalocyanine layer with a smooth charge-transporting layer so that it could act as an electrophotographic element with a screened charge-generating layer. The charge-generating layer, of course, could not locally inject any charges into the charge-transporting layer wherever the phthalocyanine layer had been blasted away.

Small holes having the same arbitrary screened pattern of removed areas can be obtained in a phthalocyanine layer vapor coated on a drum in the same way as described above. During blasting, the drum can be rotated and a blasting nozzle can be moved axially along the drum so that the entire layer on the drum is subjected to blasting along a spiral path.

While presently preferred embodiments of the invention have been described in particularity, the invention may be otherwise embodied within the scope of the appended claims.

What is claimed is:

1. A method of producing a screened layer for an electrophotographic element by applying a homogeneous layer to a support and completely removing small areas having a diameter of between about 1 and 200 μm from the homogeneous layer by blasting the layer in the absence of a screen with particles having a diameter of between 5 and 1000 μm.

2. A method of producing a screened layer for an electrophotographic element by applying a homogeneous charge-generating layer to a support and completely removing small areas having a diameter of between 1 and 200 μm from the homogeneous charge-generating layer by blasting the layer in the absence of a screen with particles having a diameter of between 5 and 1000 μm.

3. The method of claim 2 wherein a charge-transporting layer is applied to the charge-generating layer after blasting.

4. A method of producing a screened layer for an electrophotographic element by applying a homogeneous layer to a support and completely removing small areas having a diameter of between 1 and 200 μm from the homogeneous layer by blasting the layer in the absence of a screen with glass pearls having a diameter of between 5 and 1000 μm.

* * * * *